US008145371B2

(12) United States Patent
Rae et al.

(10) Patent No.: US 8,145,371 B2
(45) Date of Patent: Mar. 27, 2012

(54) DYNAMIC CONTROL SYSTEM FOR A MARINE VESSEL

(75) Inventors: Philip Andrew Rae, Christchurch (NZ); John Robert Borrett, Christchurch (NZ)

(73) Assignee: CWF Hamilton & Co. Limited, Christchurch (NZ)

( * ) Notice: Subject to any disclaimer, the term of this patent is extended or adjusted under 35 U.S.C. 154(b) by 434 days.

(21) Appl. No.: 12/303,209

(22) PCT Filed: Jun. 5, 2007

(86) PCT No.: PCT/NZ2007/000138

§ 371 (c)(1),
(2), (4) Date: Jun. 15, 2009

(87) PCT Pub. No.: WO2007/142537

PCT Pub. Date: Dec. 13, 2007

(65) Prior Publication Data

US 2010/0023192 A1 Jan. 28, 2010

Related U.S. Application Data

(60) Provisional application No. 60/810,458, filed on Jun. 2, 2006.

(51) Int. Cl.
*B63H 11/107* (2006.01)
*B63H 11/11* (2006.01)
*B63H 11/113* (2006.01)

(52) U.S. Cl. ..... 701/21

(58) Field of Classification Search ..... 701/21, 701/116; 440/5, 38, 40–43
See application file for complete search history.

(56) References Cited

U.S. PATENT DOCUMENTS 3,145,683 A * 8/1964 Kolb et al. ..... 114/144 B
3,280,311 A * 10/1966 Shatto, Jr. et al. ..... 701/116
(Continued)

FOREIGN PATENT DOCUMENTS

WO 95/28682 10/1995
(Continued)

OTHER PUBLICATIONS

Wikipedia contributors. Inertial navigation system. Wikipedia, The Free Encyclopedia. May 25, 2006, 18:27 UTC. Available at: http://en.wikipedia.org/w/index.php?title=Inertial_navigation_system&oldid=55109780. Accessed Jul. 28, 2011.*

(Continued)

*Primary Examiner* — Mark Hellner
*Assistant Examiner* — Ari M Diacou
(74) *Attorney, Agent, or Firm* — Dann, Dorfman, Herrell and Skillman, P.C.

(57) ABSTRACT

A dynamic control system for a marine vessel having two or more waterjet units as the primary propulsion system of the vessel, for maintaining vessel position or velocity when in a dynamic control mode, comprises a position or velocity indicator to indicate vessel position or velocity or deviations in vessel position or velocity; such as a satellite-based positioning system indicator, or accelerometers as a relative position indicator, a heading indicator to indicate vessel heading from position heading or yaw rate or deviations in vessel heading or yaw rate, such as a compass as an absolute heading indicator or a yaw rate sensor as a relative heading indicator, and a controller to control the operation of the waterjet units to substantially maintain the vessel position or velocity, and vessel heading or yaw rate when the dynamic control mode is enabled.

35 Claims, 7 Drawing Sheets

U.S. PATENT DOCUMENTS

| | | | | | |
|---|---|---|---|---|---|
| 3,508,512 | A | * | 4/1970 | Desrayaud et al. | 114/144 R |
| 3,945,201 | A | * | 3/1976 | Entringer | 60/222 |
| 3,965,840 | A | * | 6/1976 | Blumberg | 114/144 B |
| 3,974,792 | A | * | 8/1976 | Burnell et al. | 114/144 B |
| 4,026,235 | A | * | 5/1977 | Woodfill | 440/41 |
| 4,051,350 | A | * | 9/1977 | Parent | 701/116 |
| 4,056,073 | A | * | 11/1977 | Dashew et al. | 114/151 |
| 4,069,784 | A | * | 1/1978 | Hedstrom et al. | 114/144 E |
| 4,205,379 | A | * | 5/1980 | Fox et al. | 701/116 |
| 4,214,544 | A | * | 7/1980 | Dashew et al. | 114/151 |
| 4,316,253 | A | * | 2/1982 | Posseme | 701/116 |
| 4,317,174 | A | * | 2/1982 | Dean | 701/116 |
| 4,351,027 | A | * | 9/1982 | Gay et al. | 701/116 |
| 4,799,163 | A | | 1/1989 | Wesner | |
| 5,022,987 | A | * | 6/1991 | Wells | 210/173 |
| 5,107,424 | A | * | 4/1992 | Bird et al. | 701/21 |
| 5,282,763 | A | * | 2/1994 | Dixon | 440/42 |
| 5,386,368 | A | * | 1/1995 | Knight | 701/116 |
| 5,401,195 | A | * | 3/1995 | Yocom | 440/6 |
| 5,460,552 | A | * | 10/1995 | Blanchard et al. | 440/38 |
| 5,491,636 | A | * | 2/1996 | Robertson et al. | 701/116 |
| 5,509,369 | A | | 4/1996 | Ford | |
| 5,632,217 | A | | 5/1997 | Ford | |
| 5,884,213 | A | * | 3/1999 | Carlson | 701/206 |
| 6,032,087 | A | * | 2/2000 | Yamamoto | 701/21 |
| 6,273,771 | B1 | * | 8/2001 | Buckley et al. | 440/84 |
| 6,450,112 | B1 | * | 9/2002 | Deghuee | 114/144 R |
| 6,678,586 | B2 | | 1/2004 | Nakamoto | |
| 6,678,589 | B2 | * | 1/2004 | Robertson et al. | 701/21 |
| 6,799,528 | B1 | * | 10/2004 | Bekker | 114/151 |
| 6,865,996 | B2 | * | 3/2005 | Borrett | 114/144 B |
| 7,006,905 | B2 | * | 2/2006 | Hamamatsu et al. | 701/21 |
| 7,177,734 | B2 | * | 2/2007 | Fossen et al. | 701/21 |
| 7,214,110 | B1 | * | 5/2007 | Ehlers et al. | 440/1 |
| 7,277,359 | B2 | * | 10/2007 | Bernard | 367/131 |
| 7,769,504 | B2 | * | 8/2010 | Kaji | 701/21 |
| 7,985,108 | B1 | * | 7/2011 | Bekker et al. | 440/5 |
| 2003/0191562 | A1 | * | 10/2003 | Robertson et al. | 701/21 |
| 2004/0014373 | A1 | * | 1/2004 | McKenney et al. | 440/40 |
| 2005/0064770 | A1 | * | 3/2005 | Roos | 440/40 |
| 2005/0125142 | A1 | * | 6/2005 | Yamane | 701/200 |
| 2006/0058929 | A1 | * | 3/2006 | Fossen et al. | 701/21 |
| 2008/0015746 | A1 | * | 1/2008 | Bertazzoni | 701/21 |
| 2008/0027597 | A1 | * | 1/2008 | Barrett et al. | 701/21 |
| 2009/0023349 | A1 | * | 1/2009 | Sagov | 440/43 |
| 2009/0043436 | A1 | * | 2/2009 | Igarashi et al. | 701/21 |
| 2010/0229777 | A1 | * | 9/2010 | Khachaturian | 114/266 |
| 2011/0172858 | A1 | * | 7/2011 | Gustin et al. | 701/21 |

FOREIGN PATENT DOCUMENTS

| | | |
|---|---|---|
| WO | 01/34463 | 5/2001 |
| WO | 2005/054050 | 6/2005 |

OTHER PUBLICATIONS

Wikipedia contributors. Autonomous cruise control system. Wikipedia, The Free Encyclopedia. Jun. 16, 2011, 20:09 UTC. Available at: http://en.wikipedia.org/w/index.php?title=Autonomous_cruise_control_system&oldid=434643034. Accessed Jul. 29, 2011.*

International Search Report of PCT/NZ2007/000138, dated Nov. 9, 2007.

* cited by examiner

DYNAMIC CONTROL SYSTEM FOR A MARINE VESSEL

CROSS REFERENCE TO RELATED APPLICATION

This application claims the benefit of U.S. Provisional Application No. 60/810,458, filed Jun. 2, 2006.

FIELD OF THE INVENTION

The invention relates to control of waterjet-propelled marine vessels and in particular, but not limited to, dynamic control of a multiple waterjet marine vessel.

BACKGROUND TO THE INVENTION

Dynamic positioning refers generically to an automated method of maintaining a vessel at a fixed location without mooring or anchoring the vessel. Systems are currently available that employ dynamic positioning on large vessels, such as drilling ships. These systems are typically used to maintain vessel station in deep water often for extended periods, over a fixed point on the seabed. They are complex and typically utilize multiple purpose-provided drop down azimuth thrusters.

U.S. Pat. No. 5,491,636 discloses a dynamic positioning system which utilizes a steerable bow thruster, such as a trolling motor, to dynamically maintain a boat at a selected anchoring point.

It is an object of the present invention to provide systems and methods that provide either or both of dynamic positioning and dynamic velocity control for a waterjet-propelled marine vessel and/or that at least provide the public with a useful choice.

SUMMARY OF THE INVENTION

In a first aspect, the present invention broadly consists of a dynamic control system for a marine vessel having two or more waterjet units as the primary propulsion system of the vessel, for maintaining vessel position or velocity when in a dynamic control mode, comprising:

- a position or velocity indicator to indicate vessel position or velocity or deviations in vessel position or velocity;
- a heading indicator to indicate vessel heading or yaw rate or deviations in vessel heading or yaw rate; and
- a controller to control the operation of the waterjet units to substantially maintain the vessel position or velocity, and vessel heading or yaw rate when the dynamic control mode is enabled.

More particularly, the invention broadly consists of a dynamic control system for a marine vessel propelled by two or more waterjet units comprising:

- an input means for enabling a dynamic control mode and setting a commanded vessel position or velocity;
- a position or velocity indicator to indicate vessel position or velocity or deviations in vessel position or velocity;
- a heading indicator to indicate vessel heading or yaw rate or deviations in vessel heading or yaw rate; and
- a controller arranged to monitor for position or velocity deviations relative to a commanded vessel position or velocity and for heading or yaw rate deviations relative to a commanded vessel heading or yaw rate and to control the operation of the waterjet units to minimize position or velocity error and heading or yaw rate error when the dynamic control mode is enabled.

Typically the desired vessel position or velocity and the desired vessel heading or yaw rate are a position or velocity and a heading or yaw rate of the vessel at the time the dynamic control system is enabled (hereinafter often referred to as a current position or velocity and heading or yaw rate). The input means may be one or more buttons, switches, or the like for enabling the dynamic control mode and setting the current vessel position and heading or velocity and heading or yaw rate as the commanded position and heading or velocity and heading or yaw rate. Alternatively or additionally the input means may enable input of a commanded position and/or heading, or velocity and/or heading or yaw rate which is different from the current vessel position and heading or velocity and heading and/or yaw rate.

Preferably the commanded vessel position and heading or velocity and heading or yaw rate, may be subsequently altered while a dynamic control mode is enabled, for example using a control device such as a joystick, a helm wheel, and/or throttle lever(s).

The position or velocity indicator means may indicate an absolute vessel ground position or velocity, via for example a satellite-based positioning system such as the Global Positioning System (GPS) or differential GPS (DGPS). Alternatively, the position or velocity indicator may indicate relative position or velocity by indicating deviations in vessel position or velocity relative to the commanded vessel reference position or velocity, via one or more sensors arranged to indicate vessel motion relative to an initial position or velocity. Alternatively again the position or velocity indicator may indicate vessel position or velocity relative to another object which may be stationary or moving, such as relative to a dock or berth or relative to another stationary or moving surface or submarine vessel or relative to a diver moving under water, via for example a radar, acoustic, or laser range finding technique.

The heading indicator may indicate absolute heading via a compass, or relative heading by indicating changes in heading relative to a commanded vessel heading via a heading sensor sensitive to relative changes in vessel heading. A yaw rate sensor indicates changes in yaw rate relative to a commanded yaw rate.

Typically the controller is arranged to controllably actuate the engine throttles and steering deflectors and reverse ducts of the waterjet units. The controller is preferably arranged to actuate the steering deflectors of the waterjet units in synchronism, and the reverse ducts either in synchronism or differentially.

In a second aspect, the invention broadly consists of a computer-implemented method for dynamically controlling a marine vessel propelled by two or more waterjet units comprising the steps of:

(a) determining a commanded vessel position or velocity and heading or yaw rate;

(b) determining a current vessel position or velocity using a position or velocity determining means;

(c) determining a current vessel heading or yaw rate using a heading or yaw rate determining means; and controlling waterjet units, which are the primary propulsion system of the vessel, to substantially maintain the commanded vessel position or velocity, and vessel heading or yaw rate.

The commanded vessel position or velocity and heading or yaw rate may be the position and heading or velocity and heading or yaw rate at the time the dynamic control system is enabled, or a different vessel position and heading or velocity and heading or yaw rate which is input to a control system as the commanded position and heading or velocity and heading or yaw rate at the commencement of dynamic control or subsequently.

More particularly, the present invention broadly consists of a computer-implemented method for dynamically controlling a marine vessel propelled by two or more waterjet units comprising the steps of:

(a) receiving a commanded vessel position or velocity, and a commanded vessel heading or yaw rate
(b) determining the current vessel position or velocity using a position or velocity determining means;
(c) determining the current vessel heading or yaw rate using a heading or yaw rate determining means;
(d) calculating a position or velocity error based on the difference between the commanded vessel position or velocity, and current vessel position or velocity;
(e) calculating a heading or yaw rate error based on the difference between the commanded vessel heading or yaw rate and current vessel heading or yaw rate; and
(f) controlling the waterjet units to minimize the position or velocity error, and heading or yaw rate error.

The step of calculating a position or velocity error may comprise calculating a difference relative to an absolute vessel position or velocity or relative to an initial vessel position or velocity. The step of calculating a heading or yaw rate error may comprise calculating a heading or yaw rate error relative to an absolute heading or yaw rate or relative to an initial heading or yaw rate.

The invention may also be said broadly to consist in the parts, elements and features referred to or indicated in the specification of the application, individually or collectively, and any or all combinations of any two or more said parts, elements or features. Where specific integers are mentioned herein which have known equivalents in the art to which this invention relates, such known equivalents are deemed to be incorporated herein as if individually set forth.

The term 'comprising' as used in this specification means 'consisting at least in part of', that is to say when interpreting statements in this specification which include that term, the features, prefaced by that term in each statement, all need to be present but other features can also be present.

In this specification, the term 'vessel' is intended to include boats such as smaller pleasure runabouts and other boats, larger launches whether mono-hulls or multi-hulls, and larger vessels.

BRIEF DESCRIPTION OF THE FIGURES

Various forms of the systems and methods of the invention will now be described with reference to the accompanying figures in which.

DETAILED DESCRIPTION OF THE EMBODIMENTS

The invention is now described with reference to marine vessels that are propelled with two waterjet units at the stern of the vessel ('twin waterjet vessel'). The systems and methods of the invention may also be used on waterjet vessels propelled by more than two waterjet units, such as three or four waterjet units for example.

Dynamic Positioning System

Figure 1:
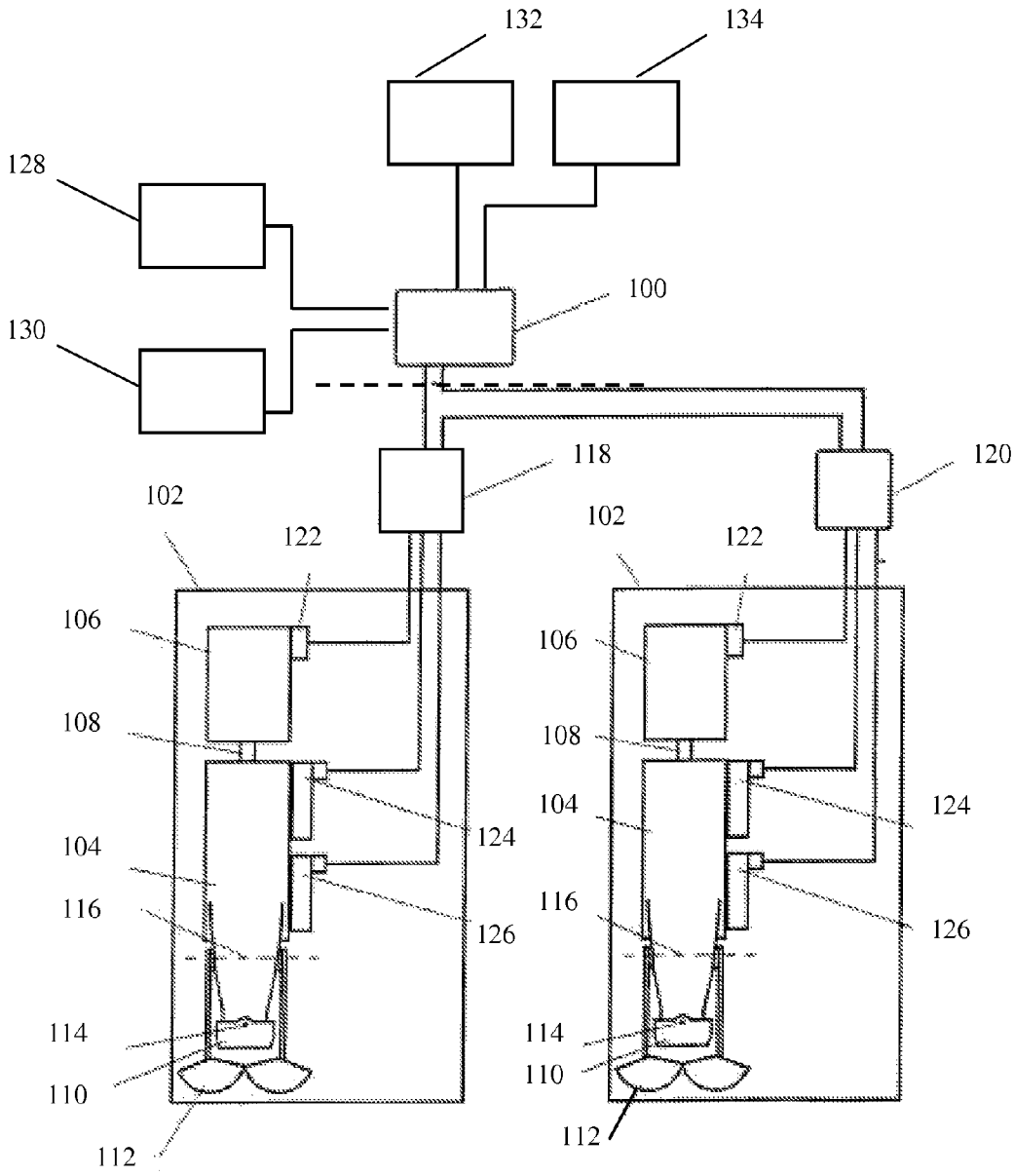
FIG. 1 shows a schematic of one example form of a dynamic positioning system.

Referring to FIG. 1, a schematic arrangement of one embodiment of a dynamic positioning system of the present invention is shown. The system includes a controller 100, such as a microprocessor, microcontroller, programmable logic controller (PLC) or the like programmed to receive and process data so as to dynamically maintain the heading and position of the vessel when the dynamic positioning mode is enabled. The controller 100 may be a stand-alone or dedicated controller for dynamic positioning or preferably is incorporated into an existing vessel controller. In one form, the controller 100 is a plug-in module that is connected to a network, such as a Controller Area Network (CAN), in the waterjet vessel.

The controller 100 controls port and starboard waterjet units 102 which are the primary propulsion systems for the vessel. Where more than two waterjet units are provided as referred to previously, the controller 100 may be adapted to provide dynamic control to at least one port waterjet unit and one starboard waterjet unit.

Each waterjet unit 102 comprises a housing containing a pumping unit 104 driven by an engine 106 through a driveshaft 108. Each waterjet unit also includes a steering deflector 110 and a reverse duct 112. In the form illustrated, each reverse duct 112 is of a type that features split passages to improve reverse thrust. The split-passage reverse duct 112 also affects the steering thrust to port and starboard when the duct is lowered into the jet stream. The steering deflectors 110 pivot about generally vertical axes 114 while the reverse ducts 112 pivot about generally horizontal axes 116, independently of the steering deflectors. The engine throttle, steering deflector and reverse duct of each unit is actuated by signals received from the actuation modules 118 and 120 through control input ports 122, 124 and 126 respectively. The actuation modules 118 and 120 are in turn controlled by the controller 100.

The controller 100 receives a number of inputs to effect vessel control. One input comes from one or more vessel control devices 128, such as one or more joysticks, helm controls, throttle levers or the like. The vessel control device(s) 128 is used by a helmsperson to manually operate the vessel.

The controller 100 also receives input from a dynamic control input means 130 which may be operated to enable a dynamic control mode, such as one or more buttons, switches, keypads or the like. The dynamic control input device 130 is used by the helmsperson to enable a dynamic control mode, including or specifically a dynamic positioning mode in which the controller controls the waterjet units of the vessel to maintain the vessel position and vessel heading. The operation of the controller in the dynamic positioning mode will be described in detail.

The controller 100 has inputs indicative of the vessel position and vessel heading. The vessel position and vessel heading are used by the controller 100 to maintain the vessel at a desired position and desired heading (herein generally referred to as a commanded vessel position and/or heading), but also to set a desired position and desired heading.

Vessel position is determined via position indicator 132. Absolute vessel ground position may be indicated via a satellite-based positioning system such as GPS or DGPS, in which case the position indicator 132 will be a GPS or DGPS unit. GPS provides data relating to earth-referenced positions in terms of latitude and longitude. GPS may be used in its standard form or in DGPS form.

Alternatively, the position indicator 132 may indicate the vessel position relative to an initial vessel reference position via one or more sensors such as accelerometers arranged to determine vessel motion relative to an initial position. An electronic circuit may receive signals representing vessel acceleration from the accelerometer(s), and integrate the signals to obtain signals representative of vessel position. Double integration of an acceleration signal produces a position signal. The outputs of a number of sensors may be processed (for example after complementary filtering) to improve the indication of position or position deviations.

In a further embodiment the position indicator 132 may indicate the vessel position relative to a stationary or moving object, such as for example relative to a dock or berth or relative to a moving or stationary surface or submarine vessel. The position indicator may comprise a short range radar system or any other system which will indicate range and bearing from the vessel to the target object whether stationary or moving, such as an acoustic or laser-based range finding system. In dynamic control with respect to moving objects, the relative positions and/or velocities between a moving object and the vessel being controlled are obtained. In this way, the controlled vessel may be controlled to maintain a rate or positional 'relationship' with the moving object. Example applications for dynamic position control with respect to moving objects include maintaining a given range and bearing from another vessel or an underwater remotely-operated-vehicle, maneuvering near a vessel that is drifting, or picking up a diver in strong tidal flow. Dynamic control with respect to moving objects may also be used to maintain vessels in a position and/or velocity relationship in pair trawling, where two or more vessels cooperatively pull a net.

The vessel heading is determined using heading indicator 134 which provides the controller 100 with vessel heading data. Heading indicator 134 may be a fluxgate compass or a gyro compass for example, which will indicate absolute vessel heading. Alternatively, the heading indicating means may indicate the vessel heading relative to an initial vessel reference heading via one or more yaw rate sensors, such as a rate gyro or other sensor device(s) arranged to determine a relative change in vessel heading. Also, the heading indicator may be an indicator already provided for an on-board auto-pilot system for example.

When the dynamic positioning is enabled, the controller 100 uses the inputs from position indicator 132 and heading indicator 134 to maintain the vessel in a commanded position and heading. This may be the position and heading of the vessel when the dynamic position system was enabled, or alternatively a different vessel position and heading input by the helmsperson or operator via another input means such as a keypad or other computer system via which another commanded position and heading may be input to the controller 100. The controller then operates the waterjet units and in particular the engine thrust, steering deflectors, and reverse ducts, in synchronism or differentially, to maintain the commanded vessel position and heading. The way in which the waterjet units may be operated to cause translation of the vessel in any direction, by the controller to maintain vessel position and heading against movement of the vessel from the desired position and heading is described in more detail in the subsequent section headed "Twin Waterjet Vessel Control".

Also, the dynamic positioning functionality may work in combination with one or more vessel control device(s) 128 used to normally operate the vessel. In one form, the input means 130 may work in combination with a slow velocity maneuvering control device of the vessel, such as a joystick, when the control system is in dynamic positioning mode. For instance, after the dynamic positioning mode is enabled in order to maintain vessel position, the helmsperson may subsequently wish to move the vessel to a different position and/or heading and then maintain the vessel at that new position and/or heading. While the control system is in dynamic positioning mode the helmsperson may operate a control device such as a joystick to move the vessel and then release the joystick or return the joystick to its neutral position. Return of the joystick to its neutral position may cause re-engaging of dynamic positioning so that the control system again operates to maintain the vessel in the new position and/or heading (until the joystick is moved again, or the dynamic positioning mode is disabled).

Dynamic Positioning Process

Figure 2:
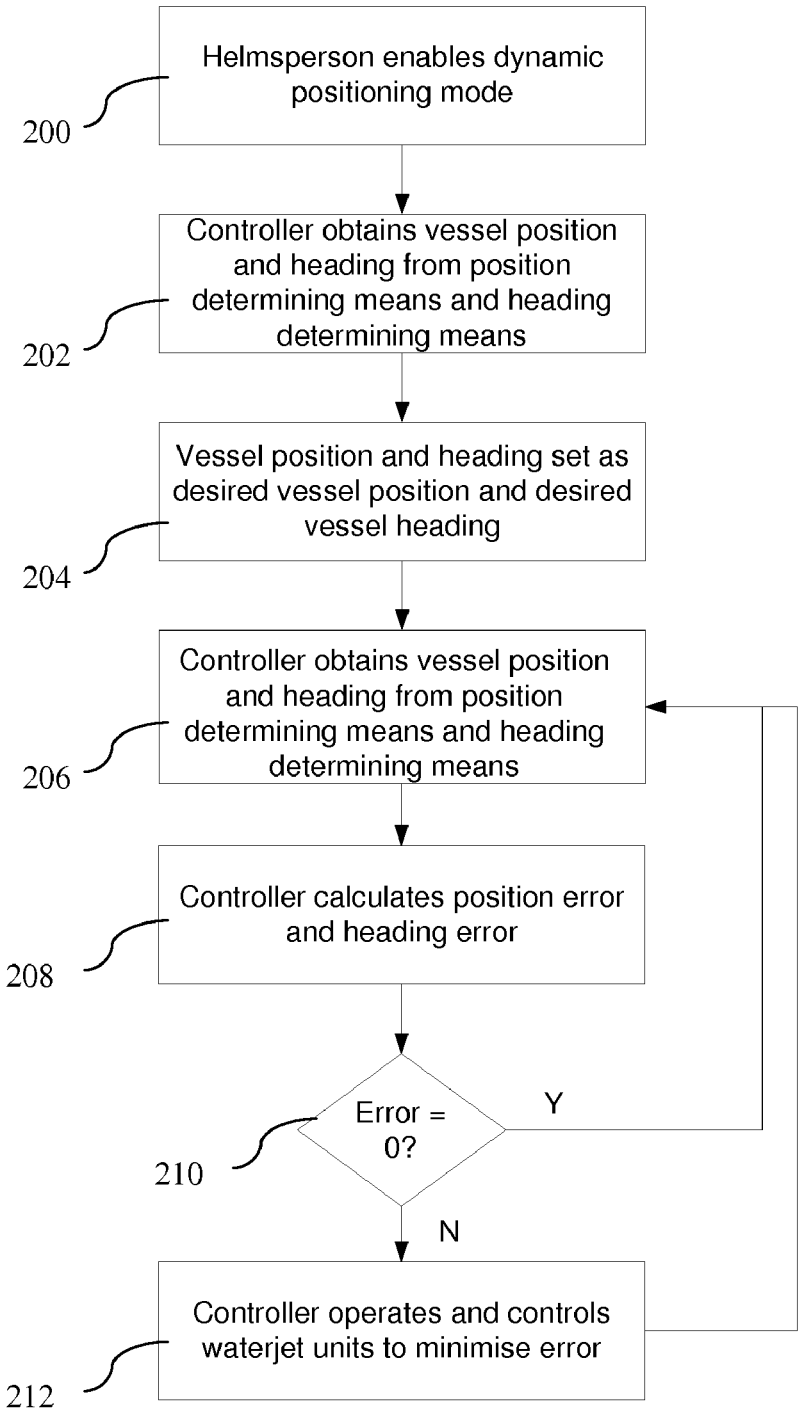
FIG. 2 shows a process flow for an example dynamic positioning method.

An example process for the controller in the dynamic positioning mode is shown in FIG. 2. Once the helmsperson has maneuvered the vessel to a selected location, relative to ground or to a dock or wharf or another stationary surface or submarine vessel for example, and wishes to dynamically maintain the vessel position and heading, the helmsperson enables the dynamic positioning mode at 200. In step 202, the controller obtains the current vessel position and vessel heading from the position indicator and heading indicator respectively. The vessel position and vessel heading obtained are set as the commanded vessel position and heading in step 204.

The controller subsequently proceeds to step 206, where it again determines the current vessel position and vessel heading from the position indicator and heading indicator respectively. In step 208, the controller calculates a position error based on the difference between the commanded vessel position as determined in step 204 and the vessel position as determined in step 206. The controller also calculates a heading error based on the difference between the commanded vessel heading as determined in step 204 and the vessel heading as determined in step 206.

In step 210, the controller determines if the position error and heading error are substantially zero. If the position error or heading error is not substantially zero, the vessel is either not in the desired position or does not have the desired heading. The controller then proceeds to step 212, where it operates and controls the waterjet units to move the vessel and minimize the position error and heading error. The process then repeats from step 206 again, where the vessel position and vessel heading are determined. Via this loop, the controller continuously monitors the vessel position and vessel heading and operates the waterjet units to maintain the commanded position and heading.

If, in step 210, the position error and heading error are found to be substantially zero, the vessel is in the commanded position and desired heading. The controller returns to step 206, where it again monitors the vessel position and vessel heading. This process continues until the dynamic positioning mode is disabled.

In an alternative embodiment the inputs to the controller instead of indicating absolute vessel position and heading may be relative vessel position and heading inputs i.e. inputs indicative of changes in vessel position and heading relative to an initial vessel position and heading. Again the controller operates and controls the waterjet units to minimize the position and heading error.

As referred to previously, instead of operating to maintain the vessel stationary at a location, being a fixed ground location and/or a fixed location relative to a dock or wharf or another stationary surface or submarine vessel for example, the dynamic positioning system may operate to maintain the vessel when moving in a particular positional relationship relative to another moving surface or submarine vessel, or for example a diver moving under water. The dynamic positioning process will be the same in concept as that outlined above except that the vessel will be moving or will move as the target vessel or object also moves. The position indicator provides information to the position of the vessel relative to the target vessel or object, using for example a radar, acoustic, or laser range finding or other similar unit.

Dynamic Velocity Control System

Figure 3:
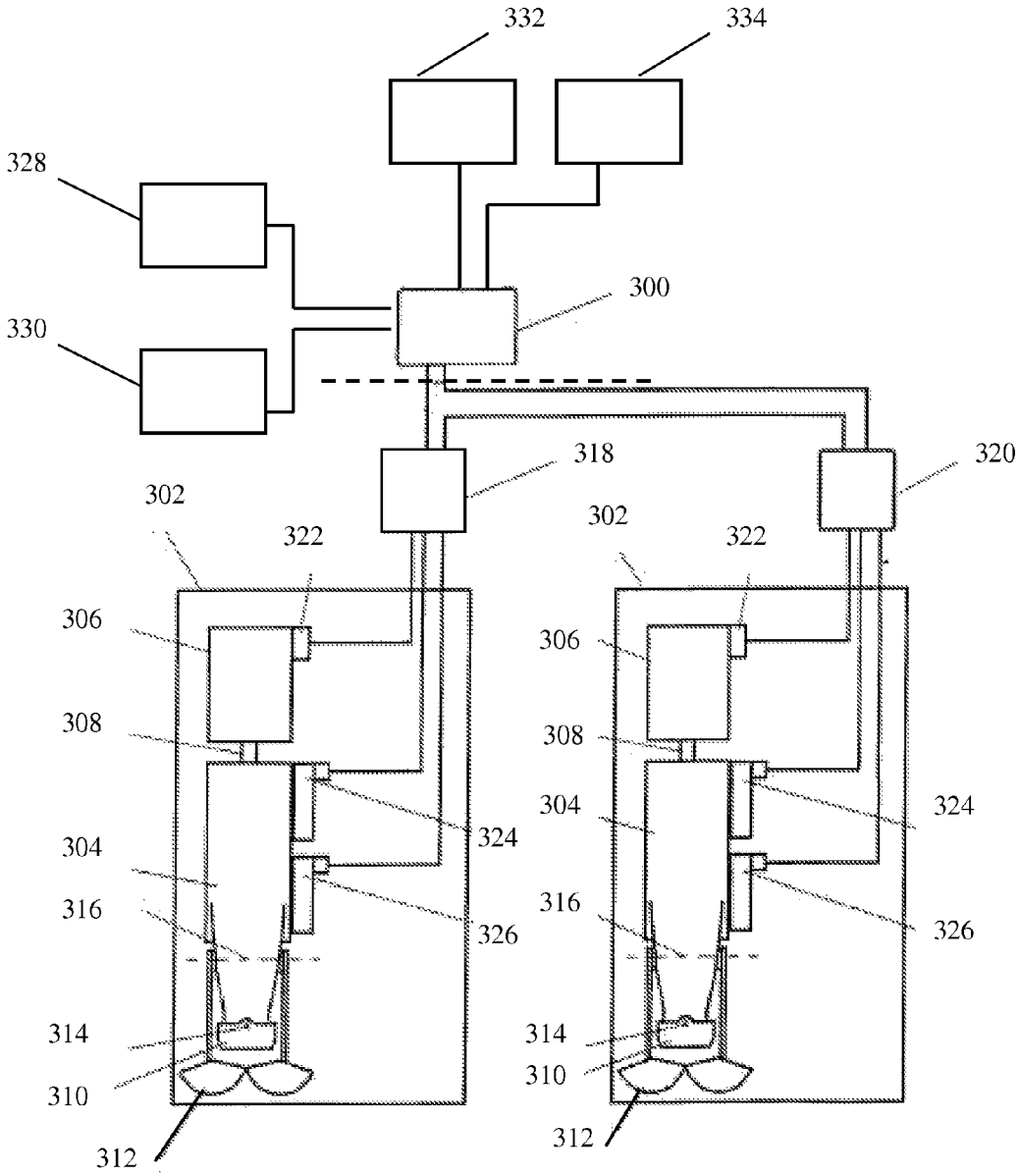
FIG. 3 shows a schematic of one example form of a dynamic velocity control system.

Referring to FIG. 3, a schematic arrangement of one embodiment of a dynamic velocity control system of the invention is shown. Although shown separately from the dynamic positioning system in FIG. 1, a dynamic velocity control system can be integrated with a dynamic positioning system to provide a dual functionality dynamic control system for a vessel. Alternatively a vessel may be provided with one or other (only) of a dynamic positioning and dynamic velocity control system of the invention.

The dynamic velocity control system includes a controller 300, which may be in the form of a microprocessor, microcontroller, programmable logic controller (PLC) or the like. The controller 300 is programmed to receive and process data so as to dynamically maintain the velocity and yaw rate of the vessel when a dynamic velocity control mode is enabled, as will be described in detail later. As before, the controller 300 may be a stand-alone or dedicated controller for dynamic velocity control or may be incorporated into an existing vessel controller, such as the controller 100 used for dynamic positioning shown in FIG. 1. In one form, the controller 300 is a plug-in module that is connected to a network, such as a Controller Area Network (CAN), in the waterjet vessel.

As shown in FIG. 3, the controller 300 controls port and starboard waterjet units 302 which are the primary propulsion system of the vessel. Where more than two waterjet units are provided as referred to previously, the controller 300 may be adapted to provide dynamic control to at least one port waterjet unit and one starboard waterjet unit.

Each waterjet unit 302 comprises a housing containing a pumping unit 304 driven by an engine 306 through a driveshaft 308, and a steering deflector 310 and a reverse duct 312 which pivot about generally vertical axes 314 and generally horizontal axes 316 respectively. The engine throttle, steering deflector and reverse duct of each unit is actuated by signals received from the actuation modules 318 and 320 through control input ports 322, 324 and 326 respectively. The actuation modules 318 and 320 are in turn controlled by the controller 300.

The controller 300 receives a number of inputs to effect vessel control. One input comes from one or more vessel control devices 328, such as one or more joysticks, helm controls, throttle levers or the like. The vessel control device(s) 328 is used by a helmsperson to manually operate the vessel.

The controller 300 also receives input from a dynamic velocity control input means 330 for enabling a dynamic velocity control mode, in which the controller controls the waterjet units of the vessel to attain and/or maintain a commanded vessel velocity and vessel heading or yaw rate.

The controller 300 has inputs indicative of the vessel velocity and vessel heading or yaw rate. The vessel velocity and vessel heading or yaw rate are used by the controller 300 to maintain the vessel at a commanded velocity and heading or yaw rate.

Referring to FIG. 3, vessel velocity is determined using a velocity indicator 332. Vessel velocity may be obtained using a number of techniques. Pilot tube sensors or ultrasonic sensors mounted on the vessel may measure vessel velocity via the time taken for ultrasonic pulses to travel through the water. Another form of velocity indicator which may be utilized is a Doppler velocity log which measures velocity via the Doppler effect. The velocity indicator may indicate the vessel velocity relative to an initial vessel reference velocity via one or more sensors such as accelerometers arranged to determine vessel velocity relative to an initial velocity. An electronic circuit may receive signals representing vessel acceleration from the accelerometer(s), and integrate the signals to obtain signals representing vessel velocity. A single integration of an acceleration signal produces a velocity signal. Alternatively, absolute vessel velocity may be derived via a satellite-based system such as GPS or DGPS. GPS or DGPS may be used to provide velocity data either directly, or indirectly by deriving the same from data relating to changes to earth-referenced positions in terms of latitude and longitude. The outputs of a number of sensors may be processed (for example after complementary filtering) to provide an improved indication of velocity or velocity deviations.

Vessel heading or yaw rate is determined using heading indicator 334 which provides the controller 300 with vessel heading or yaw rate data. Heading or yaw rate indicator 334 may be a fluxgate compass or a gyro compass which will for example indicate absolute vessel heading or from which absolute yaw rate may be determined. Alternatively, the heading indicating means 334 may indicate the vessel heading or yaw rate relative to an initial (commanded) vessel heading or yaw rate via one or more sensors such as a rate gyro or other sensor device arranged to determine a change in vessel heading or yaw rate relative to an initial heading or yaw rate.

Vessel forward velocity may be dynamically controlled when a vessel is underway at relatively high velocity for example over 10 knots, or alternatively at low velocity during slow velocity maneuvering for example, in which case the vessel velocity under control may be in any direction including forward, reverse, port or starboard movement or a combination (for example where the vessel direction is controlled during maneuvering via a joystick or other multiaxis control device).

When the velocity control mode is enabled the controller controls the propulsion units of the vessel to maintain a velocity and heading or yaw rate commanded by the helmsperson. The commanded velocity and heading or yaw rate may be the current velocity and heading or yaw rate when the velocity control mode is enabled, or a velocity and heading or yaw rate commanded after the velocity control mode is enabled if the helmsperson subsequently changes the vessel velocity and heading or yaw rate by increasing or decreasing the vessel velocity and/or using a vessel steering control device to alter the vessel heading or yaw rate. When in velocity control mode the controller actuates the propulsion units to maintain the desired velocity and heading or yaw rate, against external influences which may alter vessel velocity and heading or yaw rate such as wind, tide or currents for example. Thus when in velocity control mode the vessel will substantially maintain a commanded velocity and heading or yaw rate relative to the ground.

Existing systems have a direct relationship between a control lever position and the amount of thrust generated in a certain direction. As such, the thrust generated results in a particular rate of translation, with respect to the water rather than to ground, which can be significantly affected by external influences such as wind, tide, or currents.

The dynamic velocity control functionality may work in combination with the vessel control device(s) that are used to normally operate the vessel. In one form, the dynamic control system may work in combination with a slow velocity control device of the vessel, such as a joystick, when the control system is in dynamic control mode. For instance, once the dynamic velocity control mode is enabled, the helmsperson may wish to increase or decrease the vessel velocity or change the vessel heading or yaw rate of turn. The helmsperson may move the joystick, for instance, forwards, backwards, or in any other direction to increase or decrease the vessel velocity in that direction while the dynamic velocity control mode is enabled, or to turn the vessel or change the rate of turn of the vessel.

Dynamic Velocity Control Process

Figure 4:
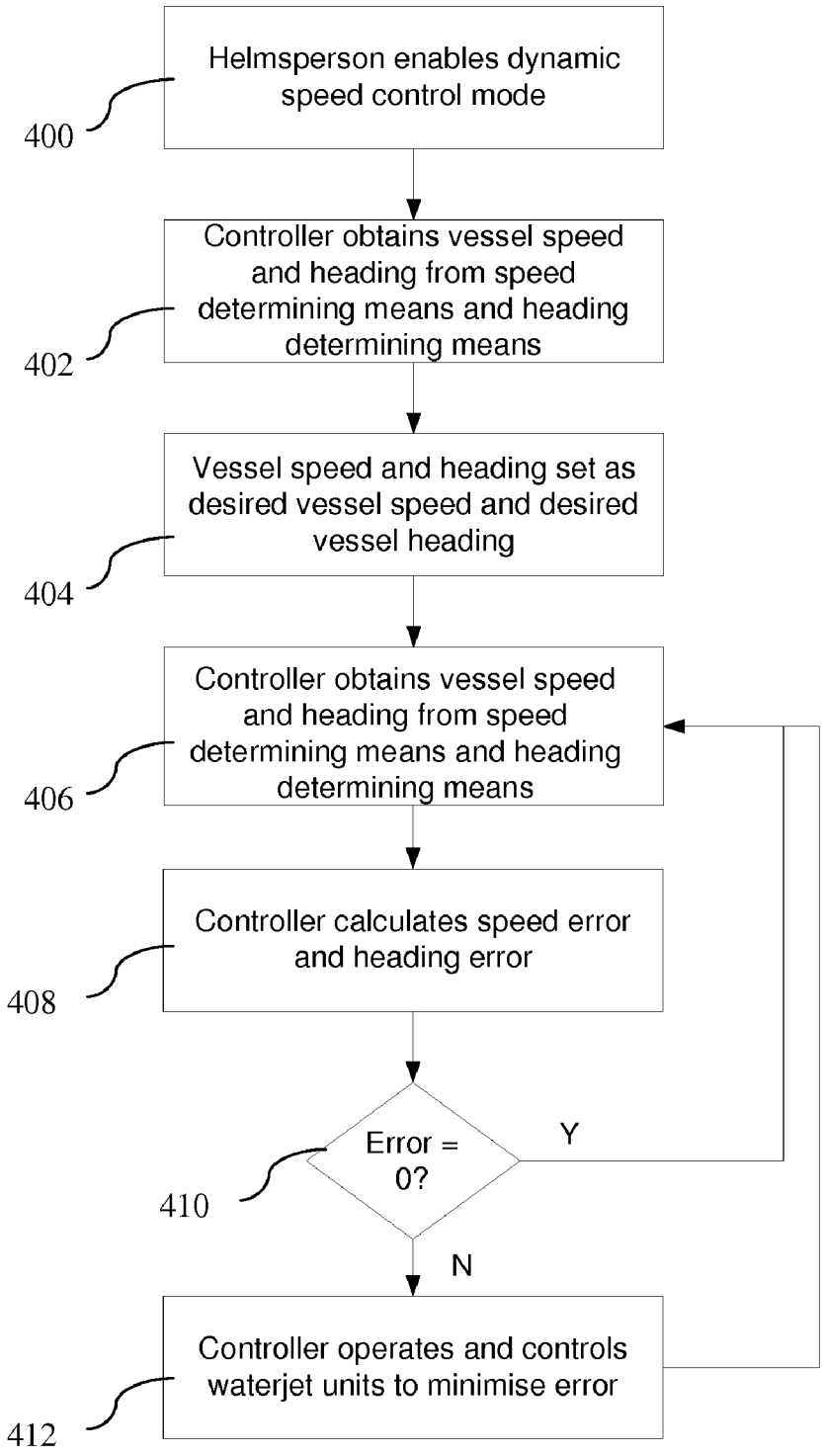
FIG. 4 shows a process flow for an example dynamic velocity control method.

An example process for the controller in the dynamic velocity control mode is shown in FIG. 4. Once the vessel has reached a desired velocity in a desired heading, and if the helmsperson wishes to dynamically maintain the vessel at that ground velocity and heading, the helmsperson actuates an input device that enables the dynamic velocity control mode at 400. In step 402, the controller obtains the current vessel ground velocity and vessel heading from the velocity indicator and heading indicator respectively. The vessel velocity and vessel heading obtained are set as the commanded vessel velocity in step 404. Alternatively the helmsperson inputs a commanded vessel velocity and/or heading through a key pad or other input means. Once inputted, the dynamic velocity control activates the propulsion system to cause the vessel to reach and maintain the commanded vessel velocity and/or heading.

The controller subsequently proceeds to step 406, where it again determines the vessel velocity and vessel heading from the velocity indicator and heading indicator respectively. In step 408, the controller calculates a velocity error based on the difference between the commanded vessel velocity as determined in step 404 and the vessel velocity as determined in step 406. The controller also calculates a heading error based on the difference between the commanded vessel heading as determined in step 404 and the vessel heading as determined in step 406.

In step 410, the controller determines if the velocity error and heading error are substantially zero. If the velocity error or heading error is not substantially zero, the vessel either does not have the commanded velocity or heading. The controller then proceeds to step 412, where it operates and controls the waterjet units to minimize the velocity error and heading error. The process then repeats from step 406 again, where the vessel velocity and vessel heading are determined. Via this loop, the controller continuously monitors the vessel velocity and vessel heading and operates the waterjet units to maintain the desired velocity.

If, in step 410, the velocity error and heading error are found to be substantially zero, the vessel has the desired velocity and heading. The controller returns to step 406, where it again monitors the vessel velocity and vessel heading. This process continues until the dynamic velocity control mode is disabled.

In an alternative embodiment the heading indicator instead of indicating absolute heading may indicate relative heading ie changes in heading relative to an initial (commanded) heading. The control system operates to maintain the vessel heading at the initial heading (until a different heading is commanded or the dynamic control system is disabled).

In a further alternative embodiment the control system may be arranged to dynamically maintain the vessel velocity and yaw rate. A yaw rate sensor will indicate yaw relative to an initial (commanded) yaw rate. For example, when a vessel is proceeding through a turn at a certain velocity and rate of turn (yaw rate), the velocity and/or rate of turn may be significantly affected by external influences such as wind, tide or currents. A yaw rate sensor indicates changes in yaw rate from the commanded yaw rate, to the controller, which operates the waterjet units to maintain the vessel at the commanded yaw rate. When the vessel is proceeding straight ahead the commanded yaw rate is zero and the controller operates to maintain the vessel at zero yaw rate against any external influences. When the vessel is turning the controller operates to maintain the vessel at the commanded yaw rate, and velocity, again against external influences.

Acceleration Control

A dynamic control system of the invention may optionally also or alternatively dynamically control acceleration or deceleration, similar to dynamic velocity control, with appropriate changes to take into account the measurement and control of acceleration, rather than velocity. An example application for a dynamic acceleration control system is to provide controlled crash-stop functionality, whereby a demand from the helmsperson for a crash-stop causes the control system to controllably decelerate the vessel such that maximum deceleration is achieved without causing injury to the helmsperson or passengers of the vessel. Another example application of the dynamic acceleration control system is a preset acceleration and deceleration routine. For instance, a preset acceleration may be programmed in a ferry to ensure passenger comfort. A preset acceleration may also be programmed in applications where an object or person, such as a water-skier, is towed by the vessel.

A controlled acceleration or deceleration mode may be initiated by the helmsperson. For example the helmsperson may operate a button, switch or similar to initiate a controlled crash-stop deceleration as referred to above, or a preset acceleration regime. Referring again to FIG. 3, the rate of vessel acceleration or deceleration is determined by a controller 300 from the signal from the velocity indicator 332. The controller 300 controls the waterjet unit 302 to cause the desired acceleration or deceleration. As before, the vessel heading is determined by a heading indicator 334 and the controller 300 also operates to maintain the desired vessel heading during the controlled acceleration or deceleration.

Alternatively a dynamic control system of the invention may simply limit the maximum rate of acceleration or deceleration permitted by the vessel. If the vessel is commanded to accelerate or decelerate to a particular velocity, the vessel will accelerate or decelerate to this commanded velocity but at a controlled rate not exceeding a predetermined acceleration or deceleration limit, to ensure for example comfort to passengers on the vessel.

Twin Waterjet Vessel Control

Operation of the waterjet units to dynamically position the vessel and/or dynamically control the vessel velocity will now be described with reference to FIG. 5. The figure shows six basic maneuvers of a twin waterjet vessel 500. For simplicity, the steering deflectors are shown as 502 and the reverse ducts when lowered are shown as 504. The reverse ducts when raised are not shown. The reverse ducts when partially lowered are shown as 506.

The steering deflectors 502 of the vessel 500 are operated in synchronism, that is, both port and starboard deflectors move in unison to direct the jet stream. In maneuvers numbered 1 and 2, the deflectors are synchronized to the centre. In maneuvers numbered 3 and 6, the deflectors are synchronized to port. In maneuvers numbered 4 and 5, the deflectors are synchronized to starboard.

The reverse ducts 504 can be operated either in synchronism or differentially. Synchronism is shown, for example, in maneuvers numbered 1 and 2, where both reverse ducts 502 are either raised or lowered. Differential operation is shown, for example, in maneuvers numbered 5 and 6, where one reverse duct 502 is raised while the other is lowered. The differential operation will be described in greater detail later with reference to FIG. 6.

Figure 5:
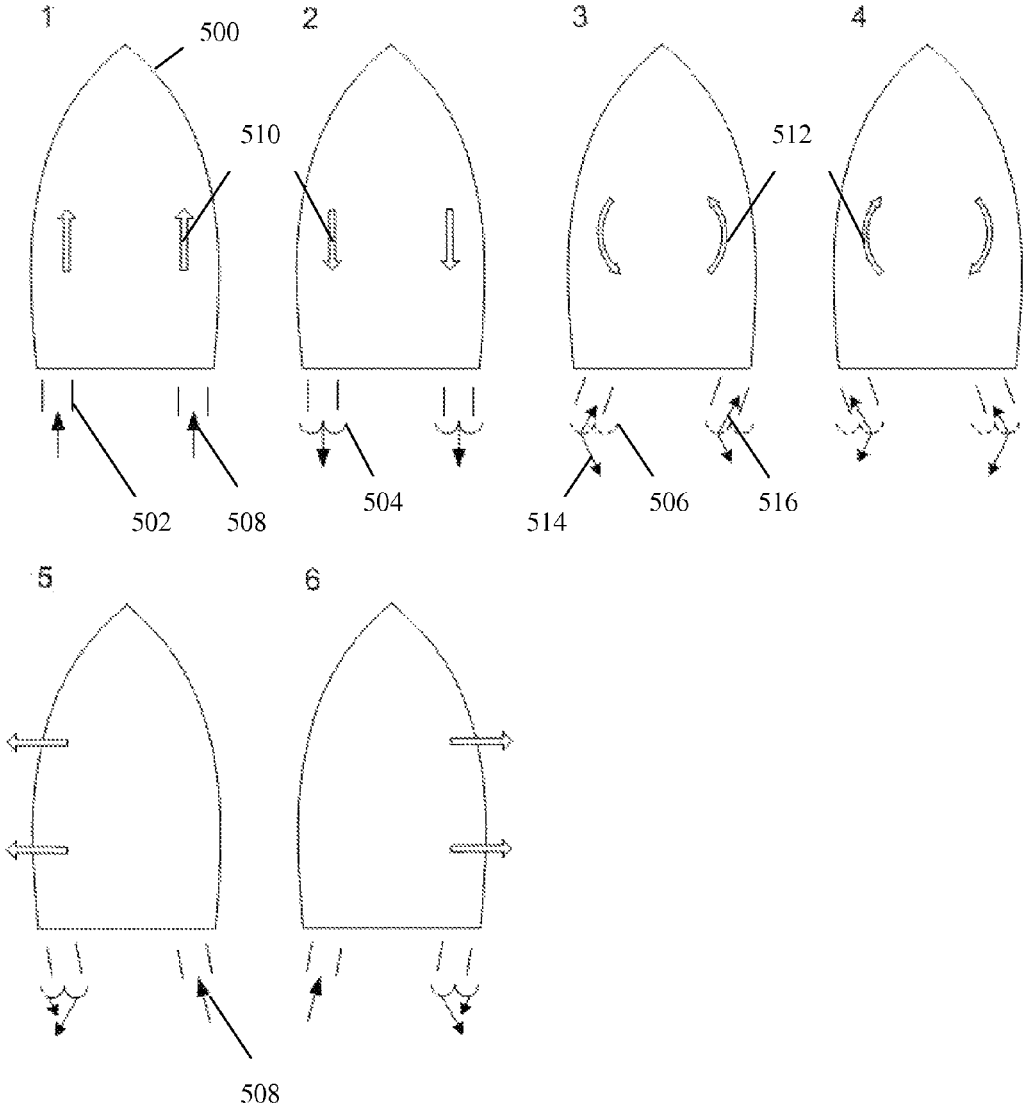
FIG. 5 shows the six basic maneuvers of a twin waterjet-propelled vessel.

As illustrated in FIG. 5, the twin waterjet vessel has four basic translation maneuvers, numbered 1, 2, 5, 6. The vessel 500 in these translation maneuvers moves ahead, astern, to port or to starboard respectively while maintaining a constant heading. The force vectors producing the translations are indicated with the arrow labelled 508, while the directions of the translation are indicated with the arrow labelled 510.

The vessel also has two basic rotation maneuvers, numbered 3, 4. The vessel 500 in these rotational maneuvers rotates to port or to starboard about a centre point in the vessel respectively. The directions of rotation are indicated with the curved arrows labelled 512.

The basic maneuvers available to the twin waterjet vessel and the associated vessel controls are summarized in Table 1 below. The maneuvers are available to both the helmsperson operating the vessel control device(s), and the controller.

TABLE 1

Summary of Vessel Manoeuvres

| | | Port Waterjet Unit | | Starboard Waterjet Unit | |
|---|---|---|---|---|---|
| No. | Type of manoeuvre | Reverse Duct | Steering Deflector | Reverse Duct | Steering Deflector |
| 1. | Translation - ahead | Up | Centre | Up | Centre |
| 2. | Translation - astern | Down | Centre | Down | Centre |
| 3. | Rotation about centre - port | Below Zero Velocity | Port | Above Zero Velocity | Port |
| 4. | Rotation about centre - starboard | Above Zero Velocity | Starboard | Below Zero Velocity | Starboard |
| 5. | Translation - port | Down | Starboard | Up | Starboard |
| 6. | Translation - starboard | Up | Port | Down | Port |

Virtually any movement or translation of the vessel may be achieved using a combination of the above basic maneuvers. The controller is able to effect any of the above maneuvers, and thus maneuver the vessel to maintain vessel position or velocity and vessel heading by controlling the vessel's waterjet units, without additional thrusters or propulsion systems to provide dynamic positioning and/or velocity control capabilities to the vessel.

Examples of Dynamic Positioning and Dynamic Velocity Control Operation

Assuming dynamic positioning mode has been enabled and the vessel begins to drift backward or astern of the desired position, the controller will first determine the position error by calculating the difference between the desired position and the vessel position resulting from the drift. Based on the position error, the controller determines the amount of engine throttle that will be required to appropriately propel the vessel forward. This step is, however, not essential as the controller may simply-send a default throttle command and monitor the resulting movement of the vessel. Referring to Table 1, the controller must also ensure the reverse ducts have been raised and the steering deflectors have been centred. The waterjet units are then operated so as to result in the maneuver numbered 1 in FIG. 5.

If the vessel has drifted forward or ahead of the desired vessel position, the controller again determines the position error, but this time determines the amount of engine throttle that is required to propel the vessel backward. As before, the determination of engine throttle may be omitted. The controller then ensures the reverse ducts have been lowered and the steering deflectors have been centred. The waterjet units are then operated such that the vessel reverses back into the desired position. The resulting maneuver is equivalent to that numbered 2 in FIG. 5. Assuming dynamic velocity control mode has been enabled and the vessel begins to slow/increase from the commanded velocity (in either forward/aft direction or port/starboard direction), the controller commanded will first determine the velocity error by calculating the difference between the desired velocity and the vessel velocity. Based on the velocity error, the controller determines the amount of engine throttle that will be required to appropriately propel the vessel at the desired velocity. This step is, however, not essential as the controller may simply send a default throttle command and monitor the resulting velocity of the vessel. It is possible that the desired velocity is in fact zero in which case the control system will attempt to maintain zero velocity.

If the vessel heading has changed, for instance where the vessel has rotated out of its desired heading, the controller first determines the heading error. Because a corrective rotation maneuver is required, referring to Table 1, the controller then ensures the steering deflectors are appropriately turned and the reverse ducts are appropriately partially lowered, depending on the required rotation direction. If a rotation to port is required, the steering deflectors are turned in synchronism to port. Also, the port reverse duct is partially lowered such that a greater portion of the jet stream from the port waterjet unit is deflected ahead. The result of this deflection is a force vector that is stronger in the direction astern, as indicated with arrow 514 in the maneuver numbered 3 in FIG. 5. The starboard reverse duct is partially lowered such that a greater portion of the jet stream from the starboard waterjet unit is deflected astern. The result is a force vector that is stronger in the direction ahead, as indicated with arrow 516 in the maneuver numbered 3 in FIG. 5. In combination, the force vectors result in the vessel rotating to port about the centre of the vessel.

If the vessel has drifted sideways away from the desired vessel position, the controller will, as before, determine the position error. Based on the position error, the controller will determine the amount of engine throttle that will be required to maneuver the vessel back to the desired position. This determination is optional and may be omitted. Because a sideways translational maneuver is needed to return to the desired position, the controller must also appropriately control the reverse ducts and the steering deflectors as noted in Table 1 above.

Assuming the vessel has drifted to the right of the desired position, the controller must control the waterjet units so that the vessel is urged to the left so as to return the vessel to the desired position. Referring to Table 1 and the maneuver numbered 5 in FIG. 5, the controller will turn both port and starboard steering deflectors in synchronism to starboard. The controller will also ensure the port reverse duct is lowered. Based on the amount of engine throttle required, the controller will control the operation of the waterjet units. As shown in the maneuver labelled 5, the combination of the steering deflectors deflected to starboard and the lowered port reverse duct results in different force vectors being generated at the stern of the vessel. As will be described with reference to FIG. 6, the sum of these force vectors results in a net sideways motion to the left.

Figure 6:
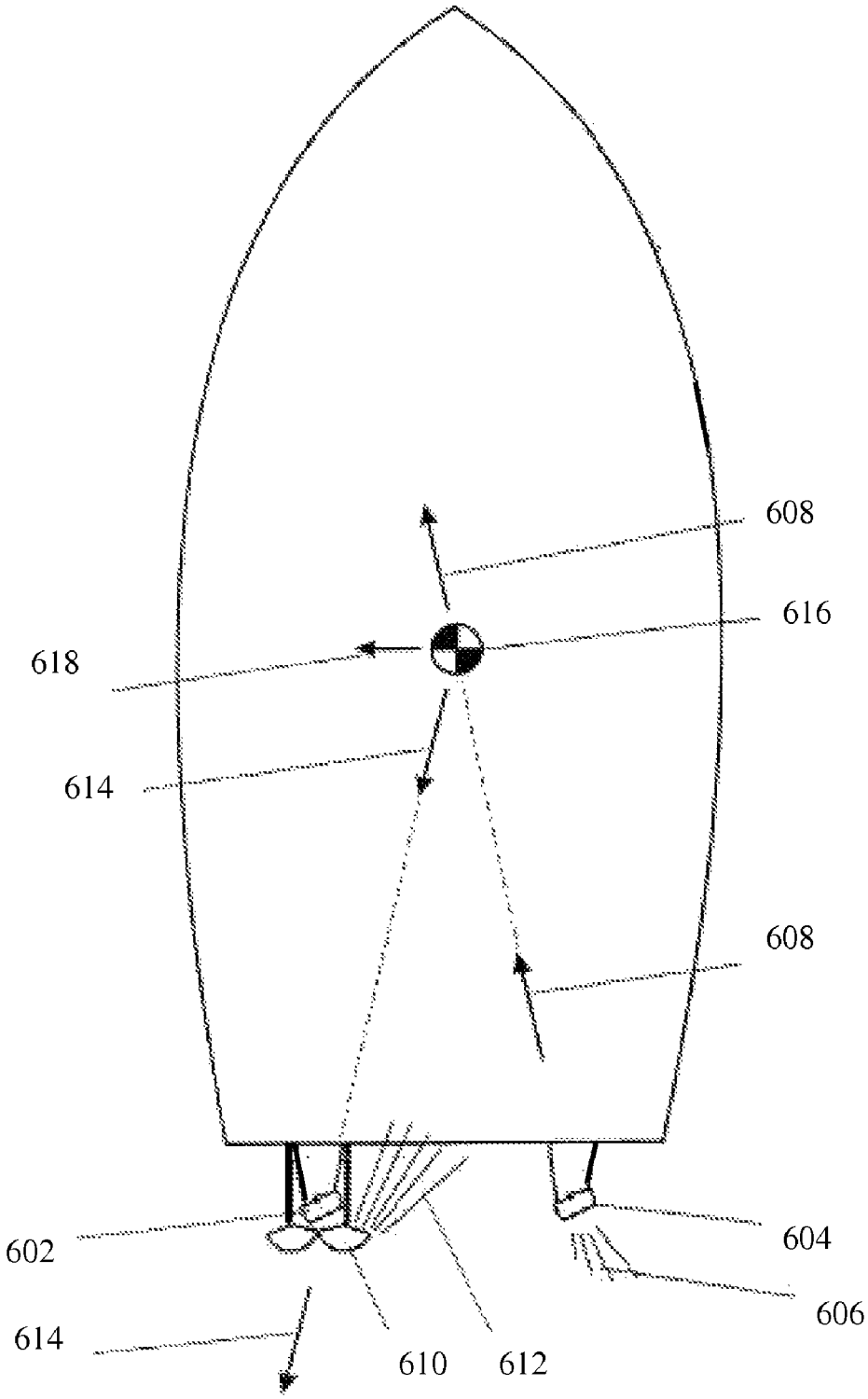
FIG. 6 shows a sideways translation of a twin waterjet-propelled vessel.

The left-sideways translation is now explained with reference to FIG. 6. The vessel 600, as in the above example, has drifted to the right of the desired position. Because the dynamic positioning mode has been enabled, the controller must urge the vessel to the left, back to the desired position. The steps taken by the controller are similar to that explained above, which include turning both steering deflectors 602 and 604 in synchronism to starboard.

Given the direction of the deflector, the starboard waterjet produces a jet stream 606, which is directed astern and to starboard. As a consequence, a force is generated in the direction opposite to the jet stream 606. This force is shown as force vector 608.

As before, the port reverse duct 610 has been lowered into place to deflect the jet stream out of the port waterjet unit. The lowered port reverse duct 610 results in a jet stream 612 being directed ahead. This results in a force being generated in the opposite direction to the jet stream 612. This force is shown as force vector 614.

By controlling the thrust of the waterjet units, and by controlling the steering deflectors and reverse ducts accordingly, the magnitude and direction of the force vectors produced may be such that they combine to produce an effective sideways force vector. At the centre of the boat, labelled as 616, the vector sum of force vectors 608 and 614 is a net sideways force vector 618. This net force vector urges the vessel to undergo a left translation.

The examples above are only exemplary and are not limiting. In practice, the vessel may be moved in a variety or combination of directions. It is expected that persons skilled in the art will be able to apply and suitably modify the above description to generate the remaining basic maneuvers listed in Table 1. Skilled persons will also appreciate that the controller may be programmed to carry out a number of discrete basic maneuvers or alternatively to combine the basic maneuvers into one operation.

As referred to previously a dynamic control system of the invention may comprise integrated dynamic position control and velocity control. This may be particularly useful for vessel maneuvering at slow velocity. With an integrated dynamic control system enabled the helmsperson may use the normal maneuvering control device such as a joystick or other multi-axis control device to move and control the vessel. When the helmsperson moves the joystick in any direction the vessel will move in the direction in which the control device is moved, and will move at a rate proportional to the amount by which the control device is moved away from its neutral position. The velocity control functionality of the invention will cause the vessel to move in the commanded direction and at the commanded rate, substantially without being affected by external factors such as wind and tide or currents. When the helmsperson moves the control device back to it's neutral position (or releases a control device biased to self-return to it's neutral position) the position control functionality will then be enabled and will cause the vessel to maintain that position again substantially without being affected by external factors such as wind and/or tide or current, until the helmsperson again moves the control device in a direction, to command a vessel to move in that direction and at the rate commanded by the degree of movement of the control device, or until the dynamic control system is disabled.

An Example Dynamic Position and Velocity Control System

A specific example of dynamic control system of the invention is now described with reference to FIG. 7. The system, indicated generally with the arrow 700, includes the following main components:

- One or more control input devices 702, such as a maneuvering joystick
- A position and heading controller 704
- The engine and waterjet propulsion systems 706, 708
- A number of vessel sensors 710, 712, 714, 716
- A system to calculate axis transformations 718

Control Input Device(s)

The control input device(s) 702 are the interface between the helmsperson, and the control system, and may consist of one or more directional control and steering units. The control input device(s) 702 may provide output signals that represent the following desired movements by the vessel:

- A commanded velocity of the vessel, ahead or astern (surge velocity, u)
- A commanded velocity of the vessel, to port or starboard (sway velocity, v)
- A commanded rate of turn of the vessel about the centre of gravity, in a clockwise or anti-clockwise direction (yaw rate, r)
- A mode input The surge and sway velocity, and the rate of turn may be demanded using known input devices such as a helm wheel, a single-axis or multiple-axis joystick, buttons, switches or the like. The input device may also be as described in our international patent application PCT/NZ2005/000319.

The mode may be demanded using one or more buttons, switches or the like to enable or select a mode of operation, as will now be described in detail.

One available mode of operation is a 'manual mode', in which an operator manually through the control system operates the waterjet units and its associated controlling surfaces in a conventional manner.

Another available mode of operation is a 'positional mode', where the control system operates the waterjet units and its associated controlling surfaces to dynamically position the vessel. Once this mode is selected, such as by pressing a 'hold' button provided on the input device described in our international patent application PCT/NZ2005/000319, the control system enables dynamic positioning. While dynamic positioning is enabled, the position at which the vessel is maintained may be adjusted in one or more of the x, y and z axes by either manipulating the steering control device or other control input device(s). For instance, a vessel may be dynamically positioned 5 metres from a dock before having its position adjusted by increments of 1 metre in the y-axis so as to controllably dock the vessel.

A further available mode of operation is a 'rate or velocity mode', where the control system operates the waterjet units and its associated controlling surfaces to dynamically control the velocity of the vessel to be consistent with a desired ground velocity. Once this mode is selected, such as by pressing a dedicated button or by inputting a desired ground velocity, the control system enables dynamic velocity control. The rate at which the vessel moves in one or more of the x, y and z axes may be adjusted by either manipulating the steering control device or other control input device(s) while dynamic velocity control is enabled. For instance, vessel velocity may be dynamically controlled at 20 knots before coming into a velocity-restricted region, and may be decremented using, for example, a 'reduce velocity' button to 10 knots upon entering the velocity-restricted region. In another example, an input control device may be provided to maintain the vessel's current velocity.

A further available mode of operation is a 'slave mode', where the control system operates the waterjet units and its associated controlling surfaces to dynamically position or control the velocity of the vessel based relative to a 'master' object, such as a lead vessel. This mode is described in context under the heading 'Dynamic Control with respect to Moving Objects'.

In the preferred form, a display means 740 is also provided. The display means 740 allows the displaying of one or more of the following parameters: vessel surge velocity, sway velocity, heading and mode of operation. The display means 740 may display the measured values of the parameters, the demanded values of the parameters, or both. It is also possible for the display means 740 to be a form of control input device by providing touch-sensitive means on the display means 740 so that a helmsperson may input demands, such as velocity changes or mode selection, by selectively touching areas of the display means 740.

Position and Heading Controller

The position and heading controller 704 receives the demands from the control input device(s) 702. It also receives feedback signals from the vessel sensors 710, 712, 714 and 716, both directly and in the form of processed data that represent the measured vessel velocities u and v.

The primary function of the position and heading controller 704 is to calculate the difference between the desired velocities and yaw rate and the measured velocities and yaw rate, and set the demands to the waterjets and engines so that the surge and sway velocity and yaw rate errors are minimized.

Propulsion Systems

The propulsion system for the port jet is shown in detail in the shaded box 706. The starboard propulsion system is identical to the port one, and is indicated by the box 708.

Each waterjet has two actuators 720 and 722 to move the steering deflector and reverse duct. The magnitude of jet thrust is varied by changing the engine velocity. A steering deflector position controller 726 receives a steering deflector demand signal from the position and heading controller 704 and a measured steering deflector position from the position sensor 728. The position controller 704 drives the actuator 720 so as to minimize the error between the demanded and measured steering deflector positions. This can be done using a conventional closed loop control system.

A second identical control loop, including a reverse duct position sensor 730 and a reverse duct position controller 732, maintains the position of the reverse duct in response to the demand signal from the position and heading controller 704.

The third part of the propulsion system block is the engine speed control. A demand signal from the position and heading controller 704 is fed to the engine control system 724 to set a specific engine speed. This varies the jet shaft rotation speed (in revolutions per minute, or RPM) and hence the magnitude of thrust produced by the waterjet.

Vessel Block

The vessel block 734 is representative of the vessel being controlled by the control system. As schematically illustrated, the vessel is acted upon by forces and moments produced by the waterjets, and external disturbances such as wind, waves, tidal flow etc. The waterjet forces and moments must be controlled to counteract the external disturbances and thus maintain the vessel on its desired trajectory as defined by the control input device(s) 702.

The combined effects of the forces and moments acting on the vessel are inputs into the vessel block 734. As a result, the vessel can be controlled to move in a certain way with respect to the surface of the Earth. These movements are represented by the 'Latitude', 'Longitude', 'Heading' and 'Yaw rate' indications shown generally as 735. It should be noted that the indications shown at 735 are not electrical signals that are input into the control system of the present invention. Instead, the indications are representative of the movements, which are sensed by sensors 710 to 716.

Vessel Sensors

The position of the vessel is preferably measured using a high accuracy system such as GPS or differential GPS. As this provides outputs of earth referenced position (latitude and longitude), latitude sensor 710 and longitude sensor 712 of the embodiment shown in FIG. 7 will be incorporated in the preferred GPS or differential GPS system.

In addition, a heading sensor 714 such as a gyro compass or fluxgate compass is used, together with a yaw rate sensor 716.

The measured parameters from the sensors above are fed directly to the position and heading controller 704 via connections V and P shown in the figure.

As an alternative to GPS and a gyro compass, accelerometers and a rate gyro may be used to control the vessel's movements based on an earlier vessel position or velocity. In this alternative form, accelerometers replace latitude and longitude sensors 710 and 712 to provide signals indicating acceleration in the x and y axes, and a rate gyro replaces the heading sensor 714 to provide signals indicating velocity changes in the z axis. The acceleration signals from the accelerometers are integrated once to produce velocity signals, and are integrated once more to produce position signals. The velocity signals from the rate gyro only need to be integrated once to produce position signals. The velocity and position signals derived from the accelerometers and a rate gyro are then input to the position and heading controller 704 via connections V and P as shown in the figure.

As another alternative to GPS and a gyro compass, radar may be used to provide relevant input signals to dynamically control the vessel. Radar provides indications of bearing and distance, which may be used to define a location at which the vessel should be dynamically positioned, or an object with respect to which the vessel's velocity should be dynamically controlled. For example, where dynamic positioning is desired with respect to a moving object, such as a another vessel, a helmsperson may use radar to indicate or select the moving object that will be the object with respect to which dynamic positioning is carried out.

Transformations

The signals from the latitude, longitude and heading sensors 710, 712 and 714 are also processed through differentiation, via differentiators 736 and 738, and axis transforms, via block 718, to provide outputs of vessel velocities u and v in the longitudinal and transverse axes. The relationships are as follows:

$$dx_{0G}/dt = u \cos phi - v \sin phi$$

$$dy_{0g}/dt = u \sin phi + v \cos phi$$

where:

$x_{0G}$=vessel longitudinal position coordinate (earth referenced axes)

$y_{0G}$=vessel transverse position coordinate (earth referenced axes)

u=vessel velocity along surge axis v=vessel velocity along sway axis phi=vessel heading angle The above equations are solved by any standard method involving two simultaneous equations in two unknowns to yield the vessel surge and sway velocities u and v. These parameters are fed to the position and heading controller 704.

Persons skilled in the art will appreciate that, where the sensors 710 and 712 are replaced with accelerometers, and sensor 714 is replaced with a rate gyro, the above transformation equations will be adapted to suit the signals generated by the accelerometers and rate gyro. For instance, since the accelerometers produce acceleration signals, integration rather than differentiation is required to produce the velocity and position signals. Also, the rate gyro produces velocity signals, which will need to be integrated to produce position signals. Some GPS systems provide direct outputs of velocity and where this is available the differentiators are not needed.

Description of Operation

The operation of the dynamic velocity control system of FIG. 7 will now be described. When the dynamic velocity control system is enabled, the control input devices 702 set the demanded longitudinal and transverse velocities and yaw rates with respect to the ground. The position and heading controller 704 determines the errors between the commanded and measured velocities and yaw rates, and calculates the steering deflector demand and reverse duct positions and engine thrust (or rpm) required to minimize these errors. These newly calculated demands are output to the steering deflector and reverse duct position controllers 726 and 732, and the engine velocity controller 724.

The propulsion system then generates thrust forces and moments that act on the vessel. The thrust forces and moments combine with disturbance forces and moments due to wind, tide etc. which together result in movement of the vessel in a direction that reduces the velocity and yaw rate errors. The motion of the vessel is detected by the sensors 710, 712, 714 and 716 to provide feedback to the position and heading controller 704, thus closing the loop.

The above described system can also seamlessly act as a dynamic positioning system to provide dynamic positioning of the vessel. This is done by setting the control input devices to a 'zero' position, where a zero velocity in surge and sway, and a zero turn rate is demanded. This causes the position and heading controller 704 to change from a 'rate' control mode, as described earlier, where the control system works to match the rate of movement and rotation to that demanded by the control input device, to a 'positional' control mode.

In one form, when the vessel is brought to a stop, the control system takes a 'snapshot' of the position and heading of the vessel. While the control input devices remain at the zero position, the 'snapshot' position and heading are used as the demand inputs and the system performs positional closed loop control, ensuring that the vessel stays in the 'snapshot' position and at the 'snapshot' heading. In this mode the 'direct' feedback and 'snapshot' signals of latitude, longitude and heading are used to calculate error signals for the positional control. This can be compared to the 'rate' or dynamic velocity control mode, where the processed signals of surge and sway velocity and the direct yaw rate signal are used as the feedback.

Figure 7:
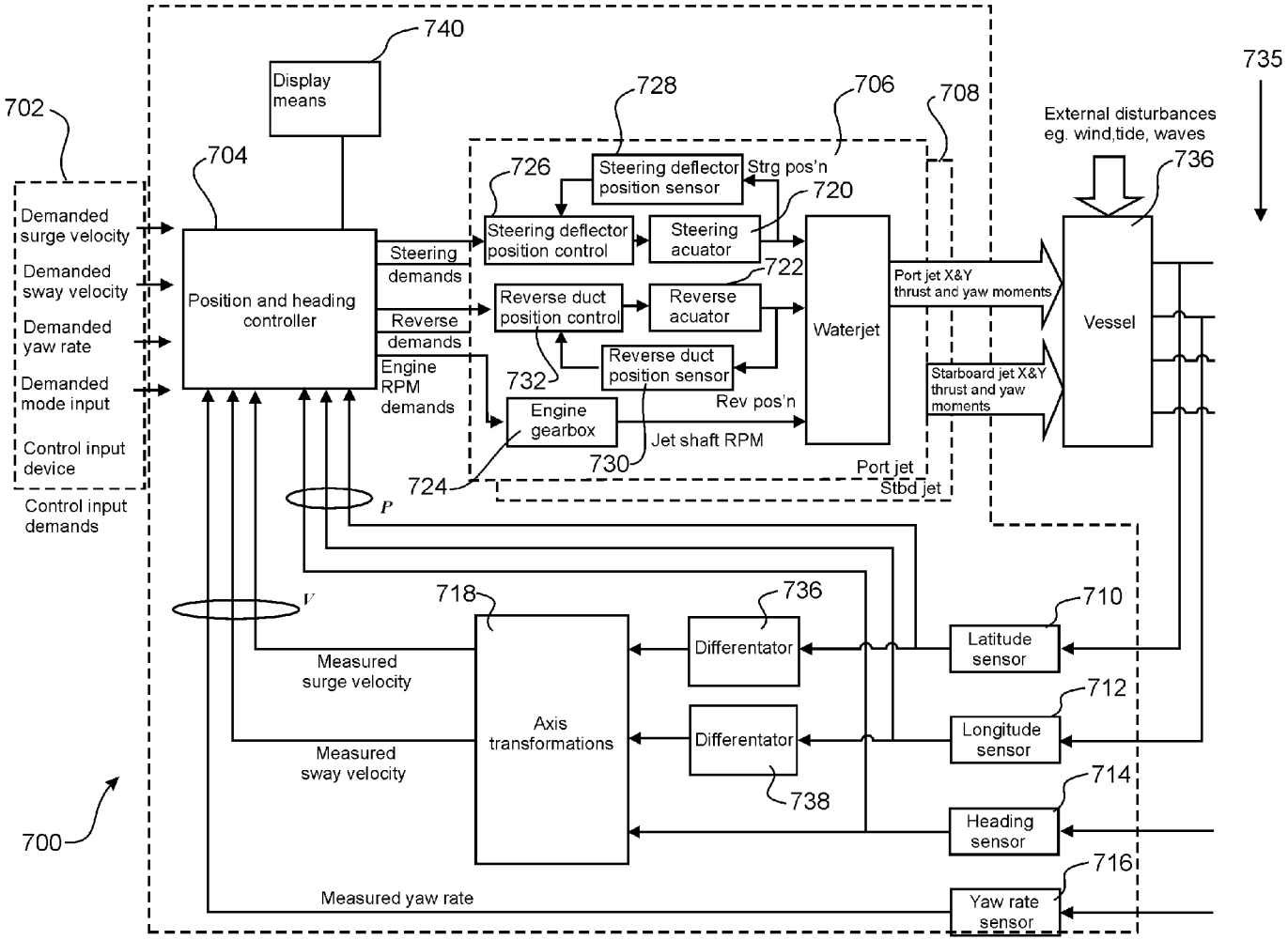
FIG. 7 shows a block diagram showing one example dynamic velocity control system.

The system described in FIG. 7 effectively contains three control loops for maintaining the longitudinal, the transverse and the rotational positions or rates. It is possible for these control loops to be in different modes at any one time. For example, when the vessel is moving with certain surge and sway velocity demands but the yaw rate demand is zero, the surge and sway control loops would be in the 'rate' mode while the yaw control loop would be in the 'positional' mode.

The foregoing describes the invention including preferred forms thereof. Alterations and modifications as will be obvious to those skilled in the art are intended to be incorporated within the scope hereof.

The invention claimed is:

1. A dynamic control system for a marine vessel having two or more waterjet units as the primary propulsion system of the vessel, the waterjet units comprising steering deflectors and reverse ducts and being operable in synchronism or differentially, the dynamic control system for maintaining vessel position or velocity when in a dynamic control mode, comprising:

a position or velocity indicator to indicate vessel position or velocity or deviations in vessel position or velocity;

a heading indicator means to indicate vessel heading or yaw rate or deviations in vessel heading or yaw rate; and a controller to control the operation of the steering deflectors and reverse ducts of the waterjet units to substantially maintain vessel position and heading, or operation of the waterjet units to substantially maintain vessel velocity and yaw rate, when the dynamic control mode is enabled.

2. A dynamic control system for a marine vessel according to claim 1 wherein said position or velocity indicator comprises a velocity indicator to indicate absolute vessel ground velocity.

3. A dynamic control system for a marine vessel according to claim 2 wherein said position or velocity indicator is arranged to indicate velocity via a satellite-based positioning system.

4. A dynamic control system for a vessel according to claim 1 comprising input means for enabling the dynamic control mode and setting a commanded vessel position or velocity and a commanded vessel heading or yaw rate.

5. A dynamic control system for a marine vessel according to claim 4 wherein the controller is arranged to monitor for position or velocity deviations relative to the commanded vessel position or velocity and for heading or yaw rate deviations relative to the commanded vessel heading or yaw rate and to control the operation of the waterjet units to minimise position or heading error, velocity or yaw rate error, when the dynamic control mode is enabled.

6. A dynamic control system for a marine vessel according to claim 1 including input means which enables setting of a current position or velocity and a current heading or yaw rate of the vessel as a commanded vessel position or velocity and a commanded vessel heading or yaw rate.

7. A dynamic control system for a marine vessel according to claim 1 including input means which enables a setting of position or velocity and heading or yaw rate which is different from a current vessel position or velocity and heading or yaw rate as a commanded vessel position or velocity and a commanded vessel heading or yaw rate.

8. A dynamic control system for a marine vessel according to claim 1 wherein the commanded vessel position or velocity and the commanded vessel heading or yaw rate can be altered while the dynamic control mode is enabled.

9. A dynamic control system for a marine vessel according to claim 1 wherein any one or more of the commanded vessel position, velocity, heading or yaw rate can be altered via a joystick, a helm wheel, and/or throttle lever(s).

10. A dynamic control system for a marine vessel according to claim 1 wherein said position or velocity indicator comprises a position indicator to indicate absolute vessel ground position.

11. A dynamic control system for a marine vessel according to claim 10 wherein said position or velocity indicator is arranged to indicate position via a satellite-based positioning system.

12. A dynamic control system according to claim 1 wherein the controller is arranged to controllably vary the engine thrust of the waterjet units when the dynamic control mode is enabled.

13. A dynamic control system for a marine vessel according to claim 1 wherein said position or velocity indicator comprises a position indicator to indicate relative position by indicating deviations in vessel position relative to a commanded vessel reference position.

14. A dynamic control system for a marine vessel according to claim 13 wherein the position indicator comprises an accelerometer.

15. A dynamic control system for a marine vessel according to claim 1 wherein said position or velocity indicator comprises a velocity indicator to indicate relative velocity by indicating deviations in vessel velocity relative to a commanded vessel reference velocity.

16. A dynamic control system for a marine vessel according to claim 15 wherein the velocity indicator comprises an accelerometer.

17. A dynamic control system for a marine vessel according to claim 1 wherein said position or velocity indicator is arranged to indicate vessel position or velocity relative to another stationary object.

18. A dynamic control system for a marine vessel according to claim 17 wherein said position or velocity indicator is arranged to indicate vessel position or velocity relative to another stationary object via a radar, acoustic, or laser range finding system.

19. A dynamic control system for a marine vessel according to claim 1 wherein said position or velocity indicator is arranged to indicate vessel position or velocity relative to another moving object.

20. A dynamic control system for a marine vessel according to claim 19 wherein said position or velocity indicator is arranged to indicate vessel position or velocity relative to another moving object via a radar, acoustic, or laser range finding system.

21. A dynamic control system for a marine vessel according to claim 1 wherein the heading indicator means is arranged to indicate absolute heading.

22. A dynamic control system for a marine vessel according to claim 21 wherein the heading indicator means comprises a compass.

23. A dynamic control system for a marine vessel according to claim 21 including a sensor to indicate changes in heading relative to a commanded vessel heading.

24. A dynamic control system for a marine vessel according to claim 1 wherein the heading indicator means comprises a yaw rate sensor.

25. A dynamic control system for a marine vessel according to claim 24 wherein the yaw rate sensor is arranged to indicate either absolute yaw rate or changes in yaw rate relative to a commanded vessel yaw rate.

26. A dynamic control system for a marine vessel according to claim 1 wherein the controller is arranged to controllably actuate the engine throttles and steering deflectors and reverse ducts of the waterjet units.

27. A dynamic control system for a marine vessel according to claim 1 wherein the controller is arranged to actuate the steering deflectors of the waterjet units in synchronism, and the reverse ducts either in synchronism or differentially.

28. A dynamic control system for a marine vessel according to claim 1 wherein the heading indicator means is arranged to indicate relative heading.

29. A dynamic control system for a marine vessel having two or more waterjet units as the primary propulsion system of the vessel, the waterjet units comprising steering deflectors and reverse ducts and being operable in synchronism or differentially, the dynamic control system for maintaining at least vessel position when in a dynamic positioning mode, comprising:

accelerometers arranged to indicate deviations in vessel position;

a yaw rate sensor arranged to indicate deviations in vessel heading; and a controller to control the operation of at least the steering deflectors and reverse ducts of the waterjet units to substantially maintain vessel position and heading when the dynamic control mode is enabled.

30. A dynamic control system for a marine vessel having two or more waterjet units as the primary propulsion system of the vessel, the waterjet units including steering deflectors and reverse ducts and being operable in synchronism or differentially, the dynamic control system for maintaining at least vessel position when in a dynamic positioning control mode, comprising:

a position indicator to indicate deviations in vessel position via a satellite-based positioning system;

a compass and a yaw rate sensor to indicate deviations in vessel heading; and a controller to control the operation of at least the steering deflectors and reverse ducts of the waterjet units to substantially maintain vessel position and heading when the dynamic control mode is enabled.

31. A dynamic control system for a marine vessel having two or more waterjet units as the primary propulsion system of the vessel, the waterjet units comprising steering deflectors and reverse ducts and being operable in synchronism or differentially, the dynamic control system for maintaining vessel position when in a dynamic position control mode, and for maintaining vessel velocity when in a dynamic velocity control mode, comprising:

position and velocity indicators to indicate vessel position and velocity or deviations in vessel position or velocity, or a combined indicator for indicating both vessel position and velocity or deviations in both vessel position and velocity;

heading indicator means to indicate vessel heading and yaw rate or deviations in vessel heading and yaw rate, or a combined indicator for indicating both vessel heading and yaw rate or deviations in both vessel heading and yaw rate; and a controller to control the operation of the steering deflectors and reverse ducts to substantially maintain vessel position and heading, or operation of the waterjet units to substantially maintain vessel velocity and yaw, rate when the dynamic control mode is enabled.

32. A computer-implemented method for dynamically controlling a marine vessel propelled by two or more waterjet units which are the primary propulsion system of the vessel, the waterjet units comprising steering deflectors and reverse ducts and being operable in synchronism or differentially, the method comprising the steps of:

(a) determining a commanded vessel position or velocity and a commanded vessel heading or yaw rate;

(b) determining a current vessel position or velocity using a position or velocity determining means;

(c) determining a current vessel heading or yaw rate using a heading or yaw rate determining means; and (d) controlling at least the steering deflectors and the reverse ducts of the waterjet units to substantially maintain the commanded vessel position and heading, or controlling the waterjet units to substantially maintain the commanded vessel velocity and yaw rate.

33. A method for dynamically controlling a marine vessel according to claim 32 also including the steps of:

(e) receiving a commanded vessel position or velocity, and a commanded vessel heading or yaw rate;

(f) calculating a position or velocity error based on the difference between the commanded vessel position or velocity, and current vessel position or velocity;

(g) calculating a heading or yaw rate error based on the difference between the commanded vessel heading or yaw rate and current vessel heading or yaw rate; and (h) controlling the waterjet units to minimise the position and/or heading error, or velocity and/or yaw rate error.

34. A dynamic control system for a marine vessel having two or more waterjet units as the primary propulsion system of the vessel, for controlling vessel acceleration and/or deceleration when in a dynamic control mode, comprising:

an acceleration indicator to indicate vessel acceleration and/or deceleration or deviations in vessel acceleration and/or deceleration;

a heading indicator means to indicate vessel heading or yaw rate or deviations in vessel heading or yaw rate; and a controller to control the operation of the waterjet units to substantially maintain the vessel acceleration and/or deceleration and vessel heading or yaw rate, when the dynamic control mode is enabled.

35. A dynamic control system for a marine vessel according to claim 34 wherein the controller is arranged to monitor for acceleration and/or deceleration deviations relative to a commanded acceleration and/or deceleration and for heading or yaw rate deviations relative to a commanded vessel heading or yaw rate and to control the operation of the waterjet units to minimise acceleration and/or deceleration error and heading or yaw rate error when the dynamic control mode is enabled.

* * * * *